US012650020B2

(12) United States Patent
Curtis

(10) Patent No.: US 12,650,020 B2
(45) Date of Patent: Jun. 9, 2026

(54) MASONRY PANEL AND FASTENER INSERT

(71) Applicant: Caleb Curtis, Moncton (CA)

(72) Inventor: Caleb Curtis, Moncton (CA)

( * ) Notice: Subject to any disclaimer, the term of this patent is extended or adjusted under 35 U.S.C. 154(b) by 216 days.

(21) Appl. No.: 18/349,743

(22) Filed: Jul. 10, 2023

(65) Prior Publication Data

US 2024/0011300 A1 Jan. 11, 2024

Related U.S. Application Data

(60) Provisional application No. 63/359,483, filed on Jul. 8, 2022.

(51) Int. Cl.
*E04F 13/08* (2006.01)
*E04F 13/14* (2006.01)

(52) U.S. Cl.
CPC ..... *E04F 13/0837* (2013.01); *E04F 13/147* (2013.01)

(58) Field of Classification Search
CPC ... E04F 13/0837; E04F 13/147; E04F 13/185; E04C 2/22; E04C 2/296; E04C 2/205; E04B 2001/386
USPC ..... 52/309.2, 506.05, 511
See application file for complete search history.

(56) References Cited

U.S. PATENT DOCUMENTS 1,840,244 A * 1/1932 Molnar ..... E04F 13/147 52/314
1,888,417 A * 11/1932 Aberson ..... E04F 13/147 D25/58
4,520,601 A * 6/1985 Stacey, Jr. ..... F16B 37/043 411/103
4,554,196 A * 11/1985 Meeker ..... E04C 2/16 428/137
4,653,246 A * 3/1987 Hepler ..... E04B 1/7629 52/309.8
4,802,802 A * 2/1989 Thurner ..... F16B 19/14 411/441
5,437,750 A * 8/1995 Rinse ..... B29C 66/72525 156/293
6,415,562 B1 * 7/2002 Donaghue ..... A47C 11/00 52/177
8,950,159 B2 * 2/2015 Cove ..... B29C 66/8242 52/745.21
9,528,274 B2 * 12/2016 Curtis ..... E04F 13/0873
2003/0121225 A1 * 7/2003 Hunsaker ..... E04F 13/0862 52/745.1
2011/0064539 A1 * 3/2011 Ghatikar ..... E04F 13/0837 411/371.2
2011/0226834 A1 * 9/2011 Scott ..... B25C 1/00 227/8

(Continued)

*Primary Examiner* — Brian E Glessner
*Assistant Examiner* — Adam G Barlow
(74) *Attorney, Agent, or Firm* — Andrews Robichaud PC; Alessandro Colonnier

(57) ABSTRACT

The present invention relates to a masonry panel for installation on a surface with the panel comprising a front-side surface and a back-side surface with the front-side surface including at least one mortar joint on the front-side surface. The masonry panel also comprises at least one fastener insert positioned within the at least one mortar joint with the at least one fastener insert comprising a transformable end to cover a fastener head once the fastener head has passed through the transformable end and a rigid tube connected to the transformable end allowing the fastener to travel through the panel.

14 Claims, 15 Drawing Sheets

(56) References Cited

U.S. PATENT DOCUMENTS

| | | | | |
|---|---|---|---|---|
| 2013/0145715 | A1* | 6/2013 | Olson | E04F 13/18 52/582.1 |
| 2015/0218829 | A1* | 8/2015 | Curtis | E04F 13/0873 52/506.05 |
| 2022/0268303 | A1* | 8/2022 | Gillis | F16B 25/0047 |

* cited by examiner

60

60

400

MASONRY PANEL AND FASTENER INSERT

FIELD

The present invention relates to masonry panels and more specifically, to masonry panels with fastener inserts which can store fasteners within the inserts.

BACKGROUND

Workers skilled in the masonry industry are familiar with masonry panels produced by means of pouring setting mixture (concrete or other) into a pliable mold body. Once material is sufficiently set, formed masonry panel may be removed.

The conventional method of installing said masonry panel onto a building, or other surface, is to apply masonry mortar to the back of masonry panel and a thin layer of mortar to a building or any other surface. The panel pressed into the bed of mortar and adhered to the building wall or surface by means of the resultant mortar bond.

This method is commonly used in the industry but has several drawbacks including: Requires skilled labor to install correctly to achieve correct mortar mixture, risk of de-lamination and dislocation of the panels if moisture intrudes behind the installed panels and freezes, "back" surface of masonry panel may have powder or weak surface that fails prior to the mortar bond, through substantial contact and little air movement there is substantial risk of moisture being retained behind the installed panel and decaying supporting wall structure.

An improved method of installing masonry panels is outlined in prior art U.S. Pat. No. 9,528,274 (masonry panel with embedded inserts). In this patent, a masonry panel to be installed on a surface through the use of embedded inserts which allows a screw or fastener to be driven through the embedded insert. As the screw is driven in, it seats against the surface formed at the abutment of the insert allowing to hide and seal the head of the screw.

While this system performs much better than traditional masonry installation methods it has a number of drawbacks: i. screws may be over-tightened by installers, breaking a portion of the panel and allowing the screw to pass fully through the panel; and ii. installing the inserts on the molds in production is a labor intense process. The dexterity required to install the inserts in the mold exceeds that of commonly available equipment or automation methods. It is desired that a much more "foolproof" method of installing be conceived so that they insert may be installed by machine in automated production.

The subject of this patent application is a new design for the insert described in prior art and an improved means of attaching inserts to a mold allowing for easier installation and manufacturing of masonry panels.

SUMMARY

In an aspect, the present disclosure provides a masonry panel for installation on a surface, the masonry panel comprising: a front-side surface and a back-side surface, the front-side surface having at least one mortar joint; and at least one insert positioned within the at least one mortar joint, the at least one insert comprising: a transformable end to cover a head of a fastener once the head has passed through the transformable end; and, a tube connected to the transformable end, the tube providing a channel through which the fastener is guided into the masonry panel.

In another aspect, the present disclosure provides an insert positioned within at least one mortar joint of a masonry panel, the insert comprising: a transformable end to cover a head of a fastener once the head has passed through the transformable end; and, a tube connected to the transformable end, the tube providing a channel through which the fastener is guided into the masonry panel.

BRIEF DESCRIPTION OF THE DRAWINGS

The embodiments of the present invention will now be described by reference to the following figures, in which identical reference numerals in different figures indicate identical elements and in which.

The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention.

DETAILED DESCRIPTION

The terms "coupled" and "connected", along with their derivatives, may be used herein. It should be understood that these terms are not intended as synonyms for each other. Rather, in particular embodiments, "connected" may be used to indicate that two or more elements are in direct physical or electrical contact with each other. "Coupled" may be used to indicated that two or more elements are in either direct or indirect (with other intervening elements between them) physical or electrical contact with each other, or that the two or more elements co-operate or interact with each other (e.g. as in a cause and effect relationship).

Figure 1:
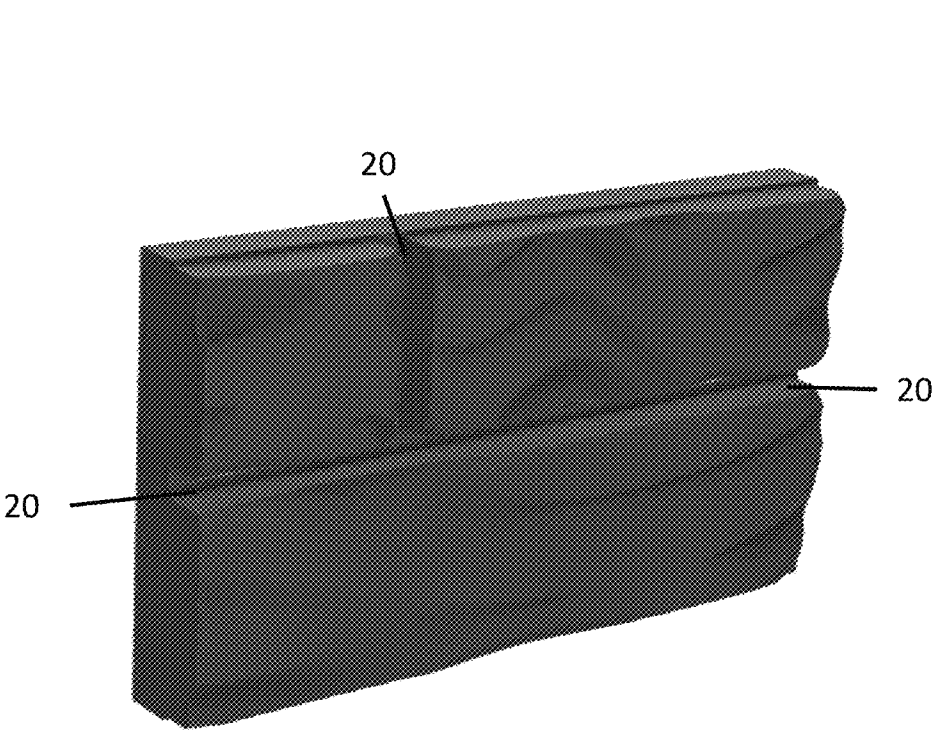
FIG. 1 is a perspective view of a masonry panel as general known in the masonry panel industry (prior art)
Figure 2:
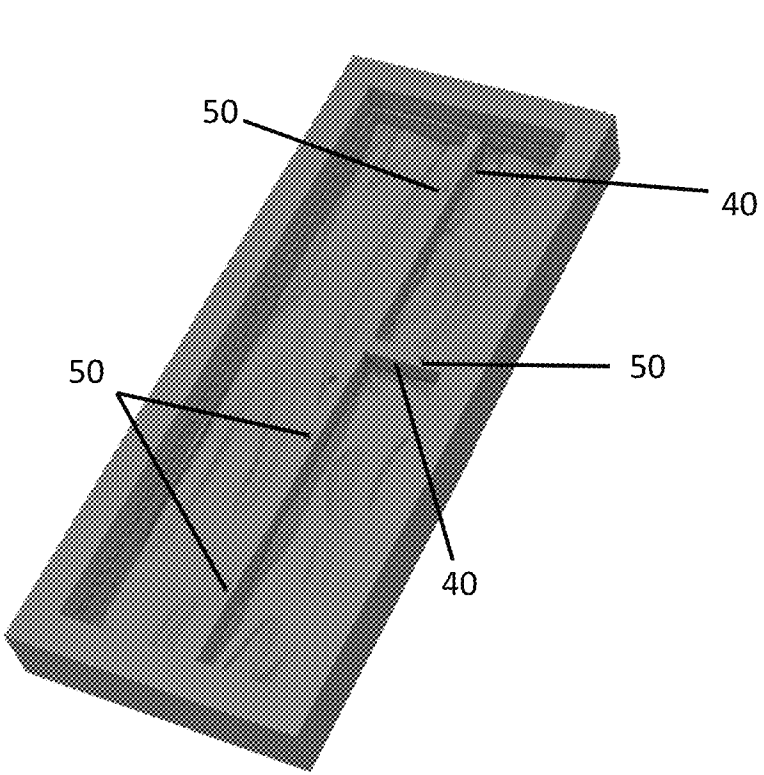
FIG. 2 is a mold used for the casting of a masonry panel according to one embodiment of the present invention.
Figure 2A:
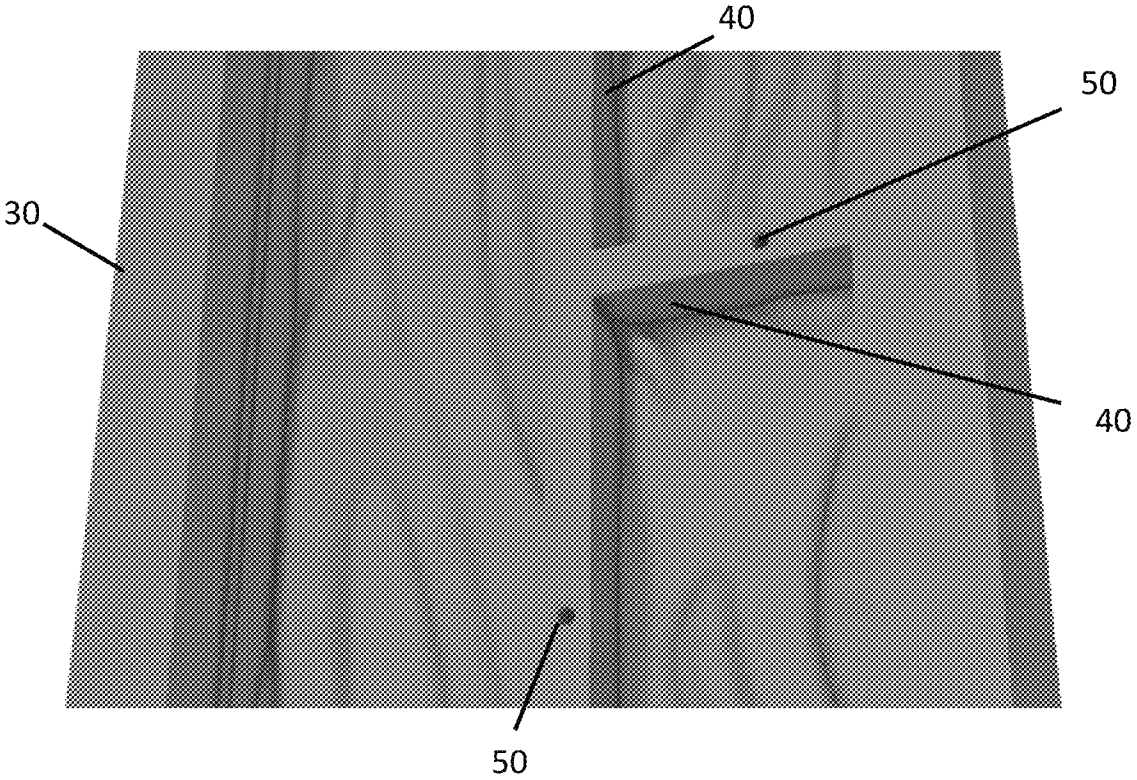
FIG. 2*a* is an exploded view of a mold with placement apertures for casting a masonry panel according to one embodiment of the present invention.

With reference to FIG. 1 and according to one embodiment of the present invention, the masonry panel 10 has mortar joints 20 that are recessed and as commonly found in masonry panels. With specific reference to FIGS. 2 and 2*a* and according to one embodiment of the present invention, a mold body 30 as typically used in the masonry panel industry has mold ridges 40 allowing to reproduced mortar joints on the top surface of a masonry panel. The mold body 30 has within mold ridges 40 placement apertures 50 allowing for the placement of inserts (not shown) which can receive fastener inserts of the present invention as will be further described below.

Figure 3:
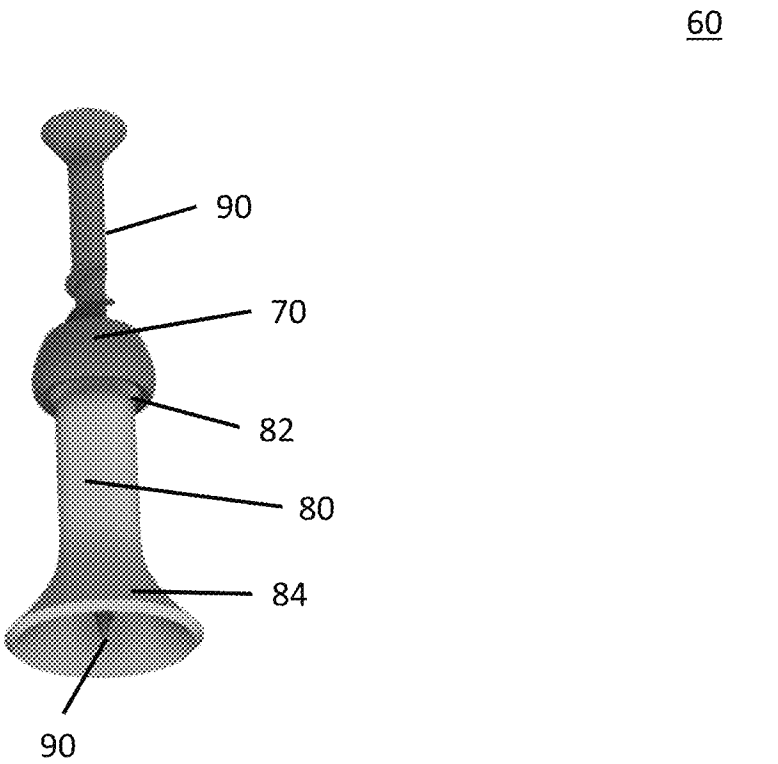
FIG. 3 is a side view of a fastener insert according to one embodiment of the present invention.

With reference to FIG. 3 and according to one embodiment of the present invention, a fastener insert 60 is shown having a transformable head 70 and a rigid tube 80. The material used for transformable head is an elastic material which allows a fastener to pierce through it while allowing the material to retain or return to its original shape. Head 70 and tube 80 are connected to one another through a mating geometry or with the use of an adhesion substance at end 82 of tube 80, or bonded by means of a typical "overmolding" injection forming process, and within the inner walls of head 70. The transformable end is formed of a resilient elastic material and is selected for color and UV resistance. The tube 80 is formed of either a rigid plastic material or corrosion resistant metallic material. A fastener 90 is positioned within head 70 and tube 80 with a first end of fastener positioned outside of head 70 and a second end of fastener within the rigid tube. With further reference to FIG. 3 and according to one embodiment of the present invention, tube 80 has a funnel shape engagement end 84 extending from the rigid tube 80 allowing to fix the fastener insert 60 within a panel as will be further described below. The funnel shape is wider than the width of the fastener insert 60 and allows for a larger bearing surface on a surface having a secured masonry panel.

Figure 3A:
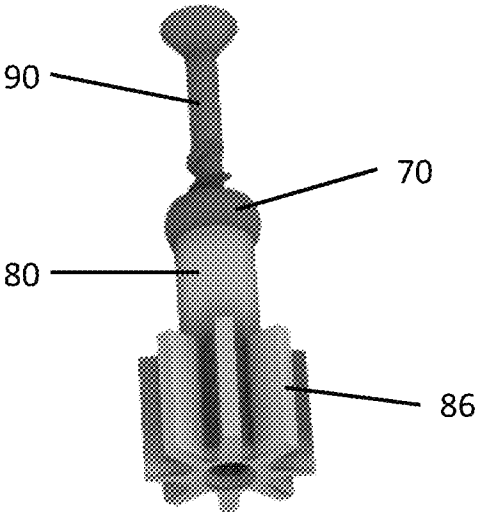
FIG. 3*a* is a side view of a fastener insert according to another embodiment of the present invention.
Figure 3B:
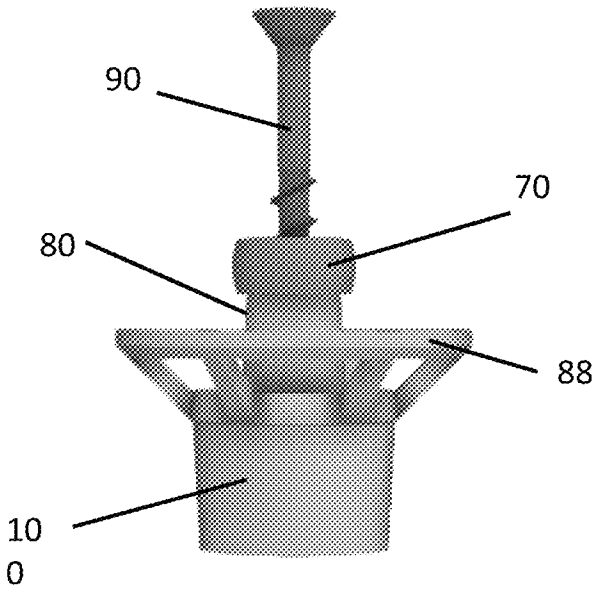
FIG. 3*b* is a side view of a fastener insert according to another embodiment of the present invention.

With reference to FIGS. 3*a* and 3*b* and according to other embodiments of the present inventions, variations of the fastener inserts 60 are shown. With specific reference to FIG. 3*a*, tube 80 has a circular engagement end 86 extending from the tube 80, the engagement end 86 opposite the transformable head 70 and being wider than the width of tube 80. Such a shape also allows to fix the fastener insert within a panel as will be further described below. The circular engagement end 86 is also comprised of longitudinal ribs, and an advantage of this shape is it allows for greater bonding between the ridged body of the insert 60 and the surrounding concrete material. With specific reference to FIG. 3*b*, tube 80 extends to a flared engagement end 88 with a spacer end 100 allowing to create a space between a panel (not shown) and a surface (not shown) having the panel installed onto it. The flared engagement end 88 has a width that is wider than the insert 60 to help secure the fastener insert 60 within a panel. A worker skilled in the relevant art would be familiar with various shapes that could be utilised to further strengthen the placement of a fastener insert within a panel. Preferably, the width of the engagement end is wider than the fastener insert 60 to better affix it within the masonry panel. The use of any particular shape is not required and an embodiment having a tube 80 with a uniform shape would still be considered as within the scope of the present invention.

Figure 4:
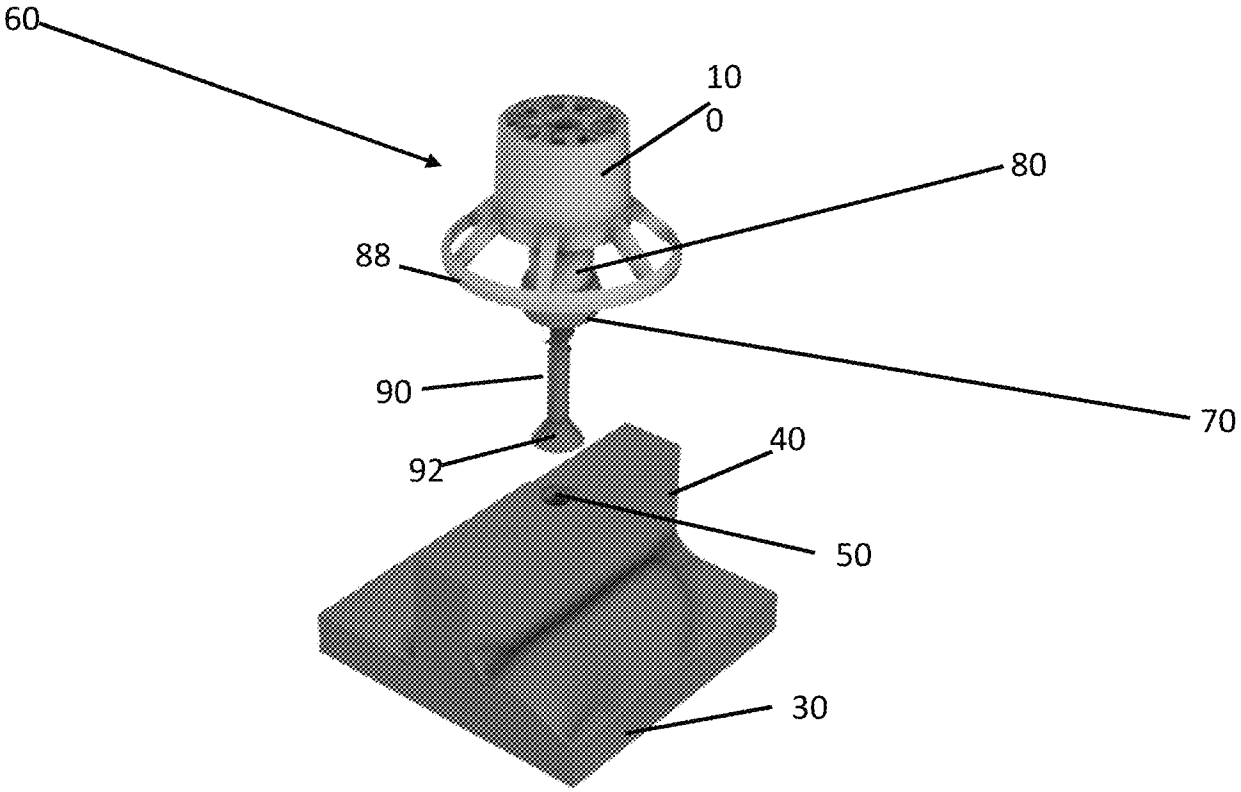
FIG. 4 is a perspective view of an insert for placement within an aperture in a mold for the casting of a masonry panel according to one embodiment of the present invention.
Figure 4A:
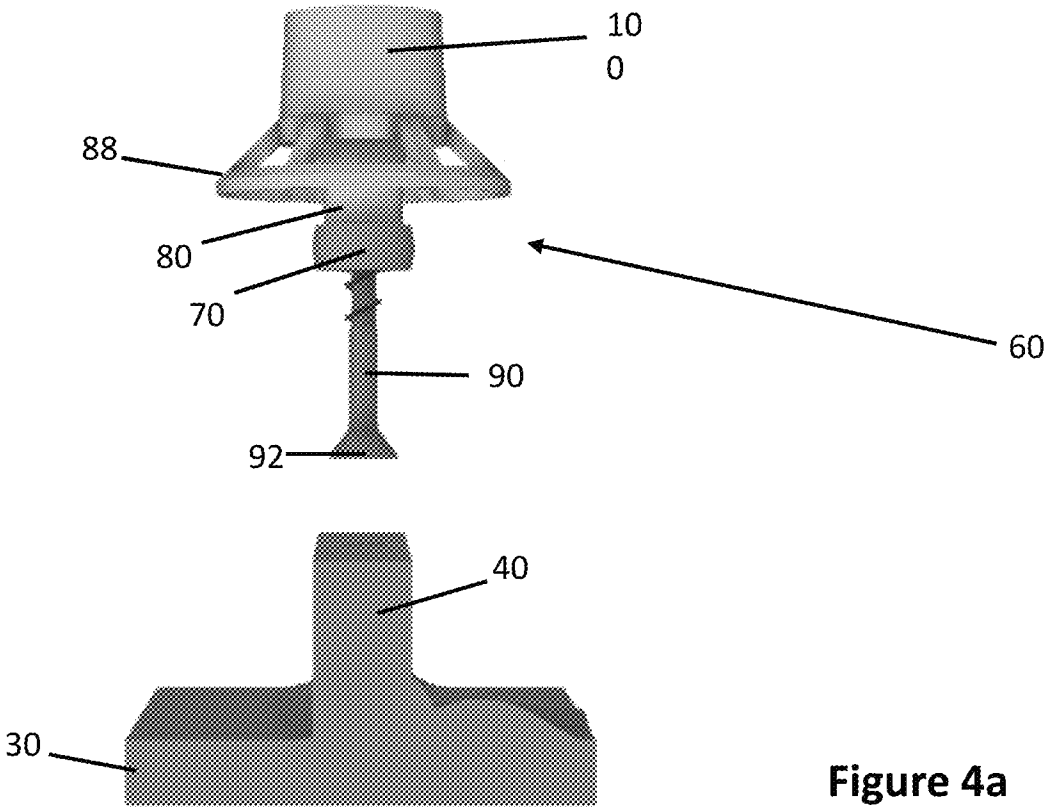
FIG. 4*a* is a side view of an insert for placement within an aperture in a mold for the casting of a masonry panel according to one embodiment of the present invention.

With reference to FIGS. 4 and 4*a* and according to one embodiment of the present invention, a fastener insert 60 is shown for placement on a mold ridge 40 of a mold body 30. The fastener insert 60 has a transformable head 70 and tube 80 with a fastener 90 positioned within head 70 and tube 80. With the fastener 90 positioned within the tube 70, the fastener insert 60 can be positioned on a mold ridge 40 having aperture 50. The fastener head 92 allows for the placement of the fastener insert 60 within aperture 50 resulting in placement of a fastener insert 60 on the mold ridge 40 in preparation for casting.

Figure 5:
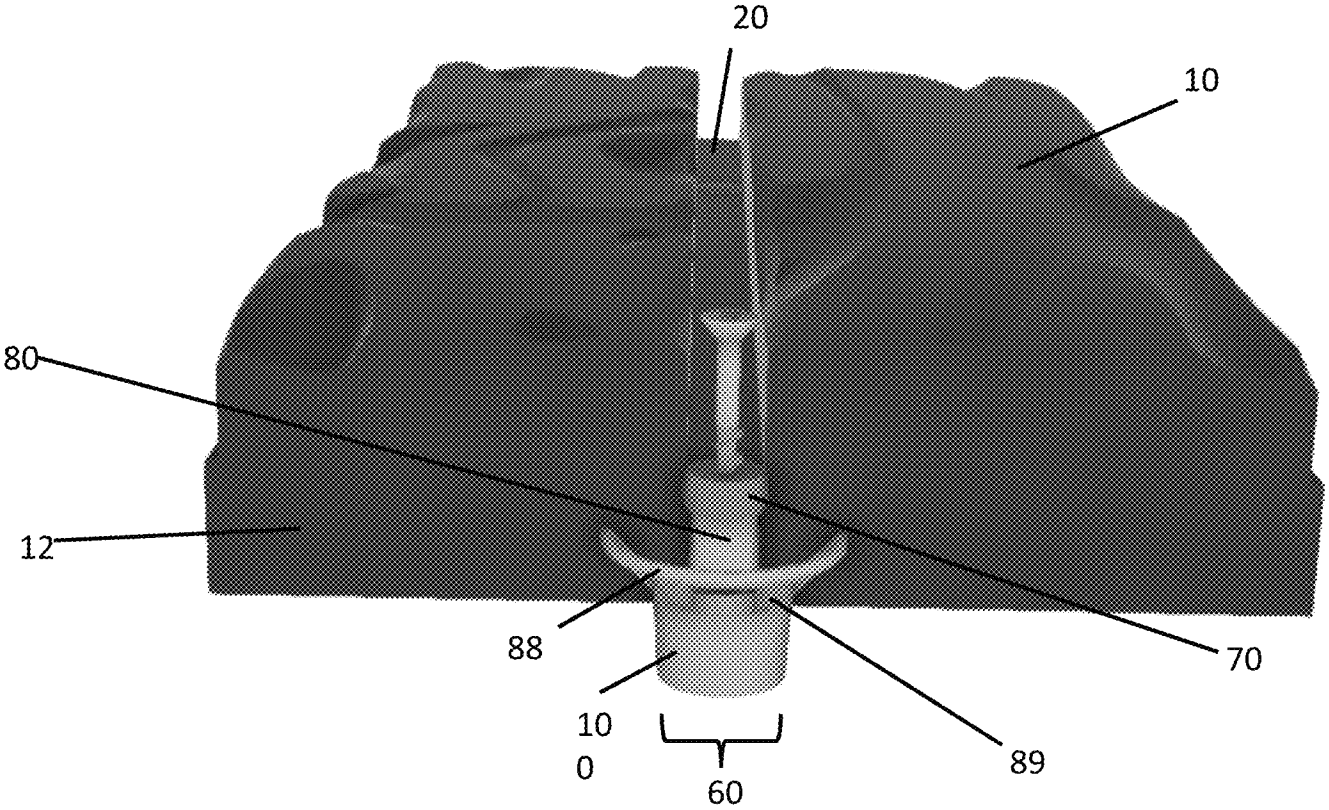
FIG. 5 is a perspective view of a fastener insert positioned within a masonry panel according to one embodiment of the present invention.
Figure 5A:
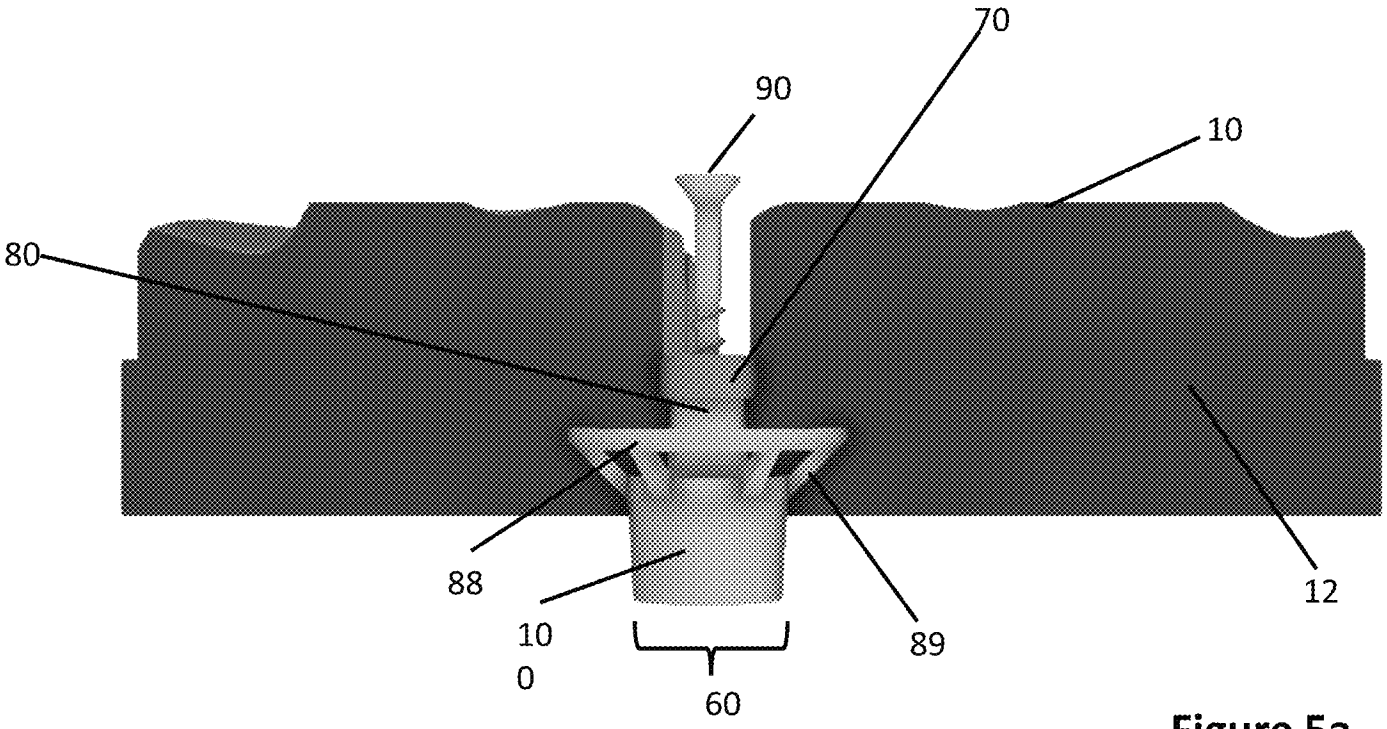
FIG. 5*a* is a side view of a fastener insert positioned within a masonry panel according to one embodiment of the present invention.

With reference to FIGS. 5 and 5*a* and according to one embodiment of the present invention, a fastener insert 60 with a fastener 90 is shown in a panel 10 after casting. Insert 60 has head 70 and tube 80 within the casting material once panel 10 is removed from the mold (not shown). The casting material 12 forming panel 10 secures the fastener insert 60 within the casting material 12 with the fastener 90 having an end within mortar joint 20 with head 70 and tube 80 within the casting material 12. The presence of engagement end 88 further fixes the insert 60 within the casting material 12, given the greater diameter of engagement end 88 in comparison to the diameter of tube 80 and the presence of ribs 89, for example. With the presence of the fastener 90 within the fastener insert 60 this provides a masonry panel ready to be installed on a surface. It eliminates the need for a fastener to be located and positioned within an insert.

Figure 6:
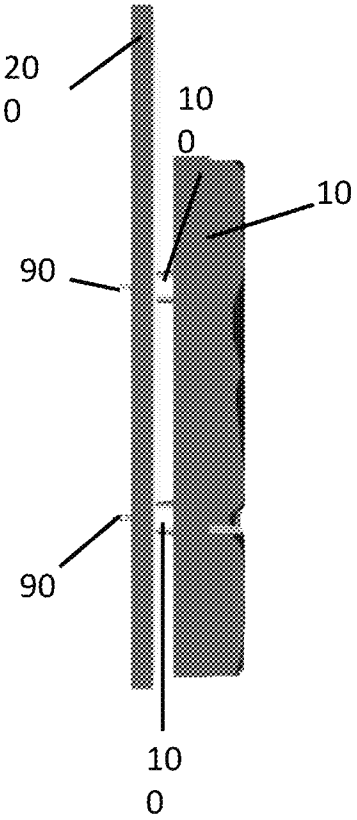
FIG. 6 is a side view of a masonry panel according to one embodiment of the present invention secured to a surface.

With reference to FIG. 6 and according to one embodiment of the present invention, fastener 90 is secured to a surface 200 to secure masonry panel 10 onto surface 200. Once fastener head (not shown) travels entirely through a transformable head (not shown) as described above (not shown), the fastener head will be covered and surrounded by the elastomeric properties of the transformable head (not shown) providing for a smooth finish within a mortar joint recessed in the masonry panel 10. The tube (not shown) with its rigidity prevents the fastener 90 from traveling too far within masonry panel 10 since fastener 90 has a fastener head (not shown) having a larger diameter than the tube used in the present fastener insert.

With further reference to FIG. 6, spacer 100 allows to create a space between panel 10 and surface 200 eliminating the need for rain screen or similar products to be installed behind the masonry panel to meet certain building codes when no space is present between the masonry panel and surface 200.

Figure 7:
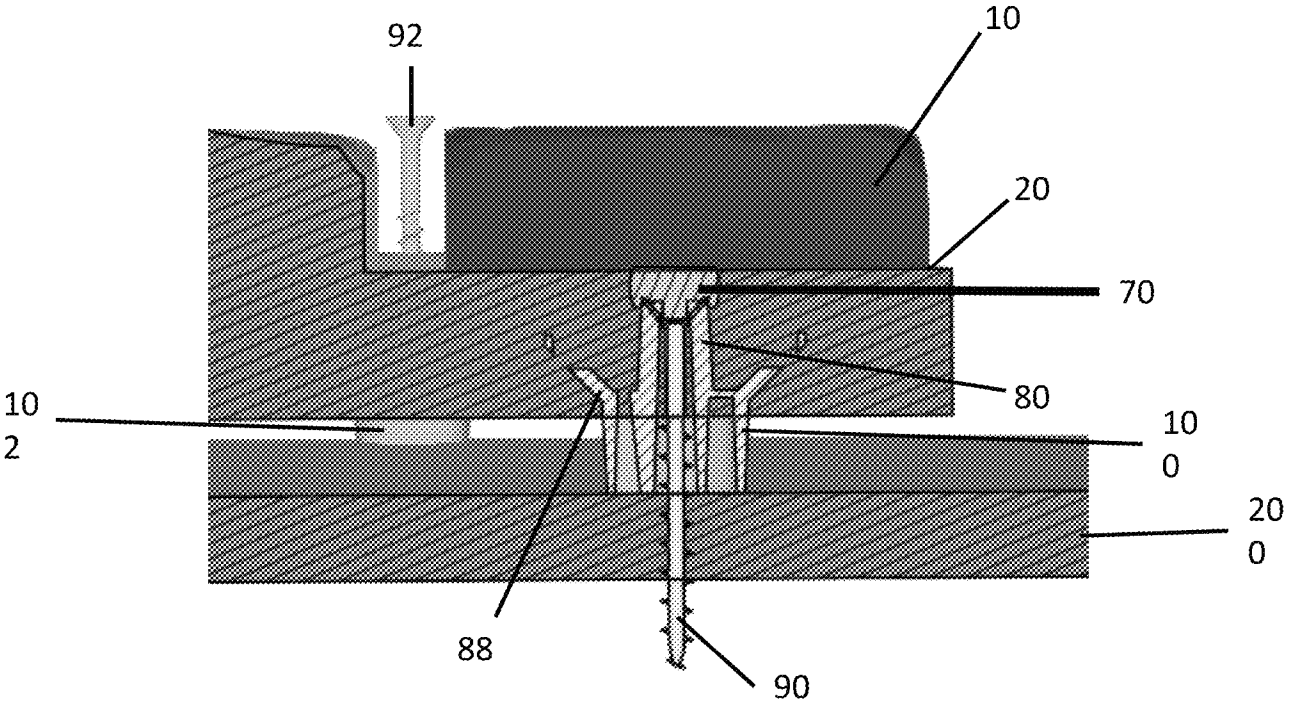
FIG. 7 is a cross-section view of a fastener insert on a masonry paned securing the masonry panel to a surface according to one embodiment of the present invention.

With reference to FIG. 7 and according to one embodiment of the present invention, a cross section of a fastener 90 secured to a surface 200 is shown. Fastener 90 is shown traveling through surface 200 allowing to secure masonry panel 10 to surface 200. Spacer 100 provides the required space as per any regulatory requirements and the thickness of spacer 100 can be varied accordingly. Engagement end 88 is shown as clearly being encased within the mortar of masonry panel 10 providing further strength to a fastener insert of the present invention. Transformable head 70 is also shown has having a uniform surface with mortar joint 20 with fastener 90 secured to surface 200. Fastener 90 also travels through tube 80 allowing to guide it to surface 200 for securing masonry panel 10. With further reference to FIG. 7, another fastener 92 is shown on masonry panel 10 having spacer 102 providing the required space between masonry panel 10 and surface 200.

Figure 8A:
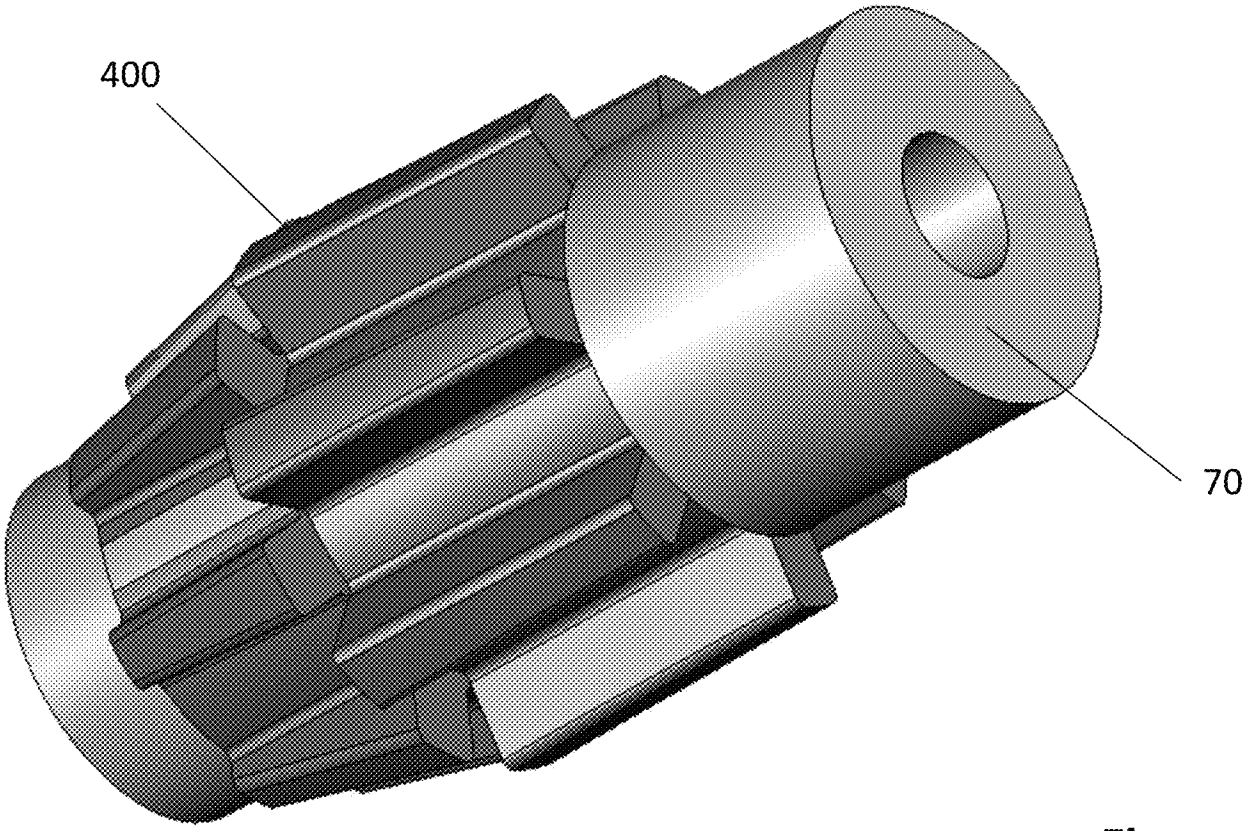
FIG. 8*a* is a perspective view of fastener end having a spacer according to another embodiment of the present invention.
Figure 8B:
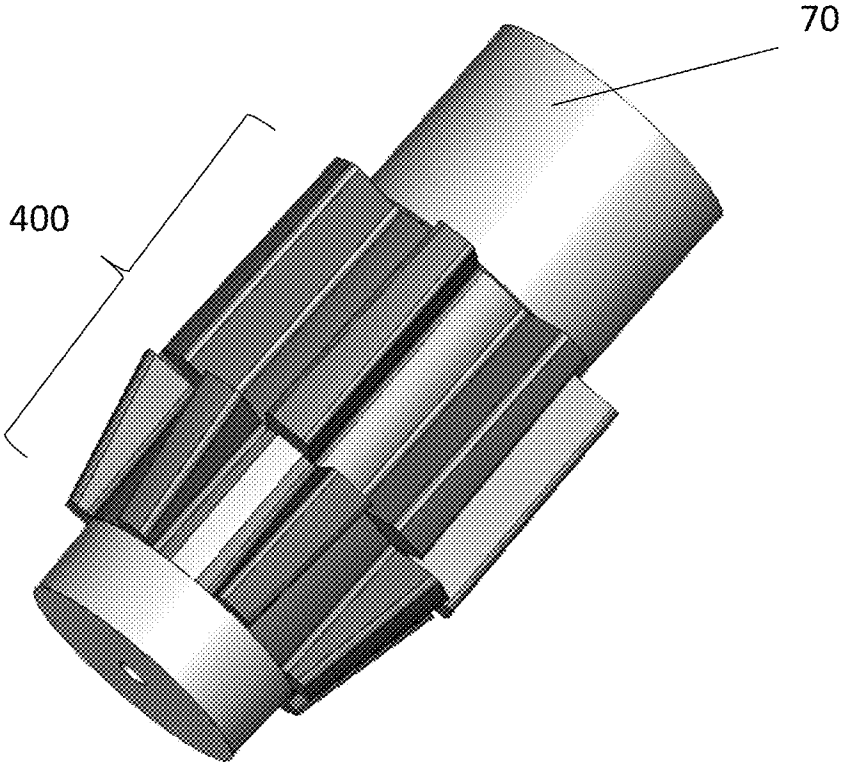
FIG. 8*b* is a perspective view of fastener end having a spacer according to another embodiment of the present invention.
Figure 8C:
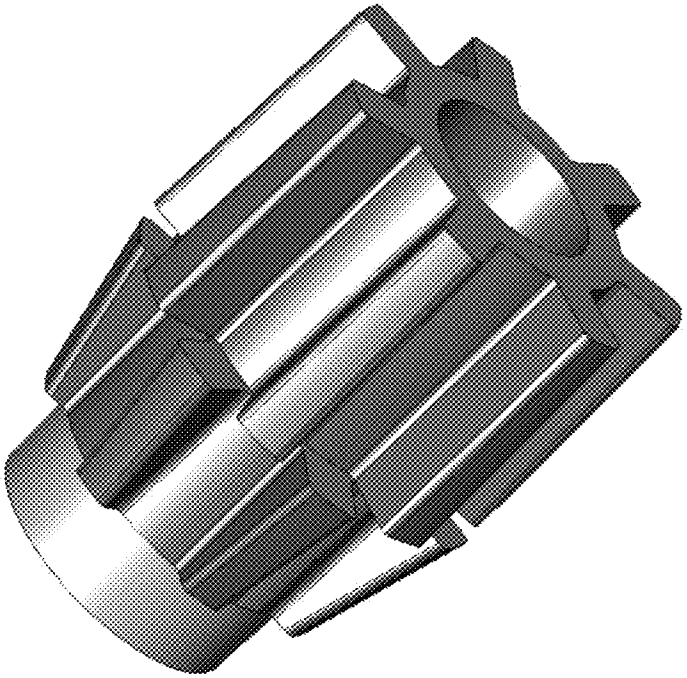
FIG. 8*c* is a perspective view of a spacer for use with a fastener of the present invention.

With reference to FIGS. 8 *a*, 8 *b* and 8 *c* another embodiment of a fastener end is shown having a spacer 400. Spacer 400 is used when a specific distance is required between a wall surface (not shown) and a masonry panel (not shown). Spacer 400 can also be independent of insert 300 and simply placed between a fastener of the present invention a wall surface wherein a masonry panel will be installed. Spacer 400 can be used without being secured or glued to tube 80 for example. The shape of the spacer 400 as shown in FIGS. 8 *a*-8 *c* allows the spacer to be inserted before installation as well as holding it in place by a friction fit of the shoulders sliding into the socket at the back of the insert. As shown in FIGS. 8*a*-8*c*, the spacer 400 may include at least one circumferential row of protruding ribs.

A surface can be defined as any wall on a building or room within a building. It can also include a floor or a ceiling.

The present invention has the further advantages such as preventing the fastener from being over-driven by having the rigid tube made of hard plastic or metallic sleeve for example. Additionally, rigid tubes may be formed to allow the panel to be spaced away from a wall thus eliminating the need for auxiliary rainscreen spacer products required for installation. Further, the nature of the insert is such that the transformable end can more completely return to its original shape. For example, as the head of a fastener completely passes through it, there is nothing holding open the fissure that results from the fastener piercing the transformable end. Without this feature an interior conical void may extend from the diameter of the fastener end through to the exterior face of the transformable end. Another advantage is that the panels may be more easily removed. As a tool to remove the fastener is re-inserted through transformable end, there is less risk of it retaining small pieces of loose elastic material abraded by the pressure and rotation of the drill bit. If the field it has been demonstrated that this material may partially, or fully, fill the driving pocket within the head of the screw so that the screwdriver tip cannot sufficiently engage with the screw pocket and therefore the screw cannot be backed out. Finally, the inserts may be more easily place by machine by means of a fastener placed in the insert prior to casting. The fastener head allows the insert to be secured on the mold through the presence of apertures in the mold as described above.

A person understanding this invention may now conceive of alternative structures and embodiments or variations of the above all of which are intended to fall within the scope of the invention as defined in the claims that follow.

The invention claimed is:

1. A masonry panel for installation on a surface, the masonry panel comprising:

a front-side surface and a back-side surface, the front-side surface having at least one mortar joint; and at least one insert positioned within the at least one mortar joint, the at least one insert comprising:

a transformable end to cover a head of a fastener once the head has passed through the transformable end; and, a tube connected to the transformable end, the tube providing a channel through which the fastener is guided into the masonry panel, wherein the at least one insert is further comprised of a spacer to provide spacing between the masonry panel and the surface, and wherein the spacer further comprises at least one circumferential row of protruding ribs.

2. The masonry panel of claim 1 further comprising a pre-installed fastener having a first end and a second opposed end, the pre-installed fastener partially positioned within the transformable end and the tube, the first end located outside the transformable end and the second opposed end located within the tube.

3. The masonry panel of claim 1 wherein the at least one insert is further comprised of an engagement end extending from the tube and opposite the transformable end, the engagement end to further secure the at least one insert within the masonry panel.

4. The masonry panel of claim 3 wherein the engagement end has a width that is wider than the tube.

5. The masonry panel of claim 3 wherein the engagement end is further comprised of a plurality of spaced apart ribs to increase the surface area between the engagement end and the masonry panel and further the secure the at least one insert within the masonry panel.

6. The masonry panel of claim 1 wherein the tube is one of: a rigid plastic material and corrosion resistant metallic material.

7. An insert positioned within at least one mortar joint of a masonry panel, the insert comprising:

a transformable end to cover a head of a fastener once the head has passed through the transformable end; and, a tube connected to the transformable end, the tube providing a channel through which the fastener is guided into the masonry panel, wherein the insert is further comprised of a spacer to provide spacing between the masonry panel and a surface, and wherein the spacer further comprises at least one circumferential row of protruding ribs.

8. The insert of claim 7 further comprising a pre-installed fastener having a first end and a second opposed end, the pre-installed fastener partially positioned within the transformable end and the tube, the first end located outside the transformable end and the second opposed end located within the tube.

9. The insert of claim 7 wherein the at least one insert is further comprised of an engagement end extending from the tube and opposite the transformable end, the engagement end to further secure the at least one insert within the masonry panel.

10. The insert of claim 9 wherein the engagement end has a width that is wider than the tube.

11. The insert of claim 9 wherein the engagement end is further comprised of a plurality of spaced apart ribs to increase the surface area between the engagement end and the masonry panel and further the secure the insert within the masonry panel.

12. The insert of claim 7 wherein the tube is one of: a rigid plastic material and corrosion resistant metallic material.

13. The masonry panel of claim 1, wherein the at least one circumferential row of protruding ribs comprises a first circumferential row of protruding ribs positioned adjacent to a second circumferential row of protruding ribs, the first circumferential row of protruding ribs being in a longitudinally staggered alignment with the second circumferential row of protruding ribs.

14. The masonry panel of claim 7, wherein the at least one circumferential row of protruding ribs comprises a first circumferential row of protruding ribs positioned adjacent to a second circumferential row of protruding ribs, the first circumferential row of protruding ribs being in a longitudinally staggered alignment with the second circumferential row of protruding ribs.

* * * * *